US007311933B2

(12) United States Patent
Bringley et al.

(10) Patent No.: US 7,311,933 B2
(45) Date of Patent: Dec. 25, 2007

(54) PACKAGING MATERIAL FOR INHIBITING MICROBIAL GROWTH

(75) Inventors: Joseph F. Bringley, Rochester, NY (US); David L. Patton, Webster, NY (US); Richard W. Wien, Pittsford, NY (US); Yannick J. F. Lerat, Mellecey (FR)

(73) Assignee: Eastman Kodak Company, Rochester, NY (US)

( * ) Notice: Subject to any disclaimer, the term of this patent is extended or adjusted under 35 U.S.C. 154(b) by 463 days.

(21) Appl. No.: 10/823,453

(22) Filed: Apr. 13, 2004

(65) Prior Publication Data

US 2005/0226966 A1 Oct. 13, 2005

(51) Int. Cl.
*B65B 55/00* (2006.01)

(52) U.S. Cl. ..... 426/124; 426/127; 426/133; 426/415; 428/35.2; 428/35.7; 428/35.9

(58) Field of Classification Search ..... 426/132
See application file for complete search history.

(56) References Cited

U.S. PATENT DOCUMENTS

| | | | | |
|---|---|---|---|---|
| 5,096,724 | A | 3/1992 | Zenner et al. | 426/124 |
| 5,244,861 | A | 9/1993 | Campbell et al. | 503/227 |
| 5,492,742 | A * | 2/1996 | Zenner et al. | 428/35.2 |
| 5,573,800 | A * | 11/1996 | Wilhoit | 426/326 |
| 5,759,653 | A * | 6/1998 | Collette et al. | 428/35.9 |
| 5,853,965 | A | 12/1998 | Haydock et al. | 430/496 |
| 5,854,303 | A * | 12/1998 | Powell et al. | 523/106 |
| 5,866,282 | A | 2/1999 | Bourdelais et al. | 430/22 |
| 5,874,205 | A | 2/1999 | Bourdelais et al. | 430/496 |
| 5,888,643 | A | 3/1999 | Aylward et al. | 428/315.9 |
| 5,888,681 | A | 3/1999 | Gula et al. | 430/20 |
| 5,888,683 | A | 3/1999 | Gula et al. | 430/22 |
| 5,888,714 | A | 3/1999 | Bourdelais et al. | 430/536 |
| 5,985,342 | A * | 11/1999 | Ruzek | 426/281 |
| 6,465,065 | B1 * | 10/2002 | Teumac et al. | 428/35.7 |
| 6,667,082 | B2 * | 12/2003 | Bamore et al. | 428/34.8 |
| 6,933,046 | B1 * | 8/2005 | Cook | 428/402 |
| 6,933,055 | B2 * | 8/2005 | Share et al. | 428/474.4 |
| 7,029,768 | B1 * | 4/2006 | Ohmori et al. | 428/702 |
| 7,033,455 | B1 * | 4/2006 | Berlin et al. | 156/244.11 |

FOREIGN PATENT DOCUMENTS

| | | |
|---|---|---|
| EP | 0 384 319 | 8/1990 |
| EP | 0 750 853 | 1/1997 |
| FR | 2 718 352 | 4/1994 |
| GB | 1 393 893 | 5/1975 |

OTHER PUBLICATIONS

"Inorganic Chemistry in Biology and Medicine", by Raymond et al., Chapter 18, ACS Symposium Series, Washington, DC (1980).

(Continued)

*Primary Examiner*—Peter A. Hruskoci
(74) *Attorney, Agent, or Firm*—Frank Pincelli

(57) ABSTRACT

A packaging material used for wrapping foodstuffs and for inhibiting the growth of micro-organisms in foodstuffs, the packaging material having a metal-ion sequestering agent capable of removing designated metals ions from the surfaces of the foodstuffs and from liquid extrudates of foodstuffs.

46 Claims, 8 Drawing Sheets

OTHER PUBLICATIONS

"Inorganic Chemistry in Biology and Medicine", by Raymond et al., Chapter 17, ACS Symposium Series, Washington, DC (1980).

"Critical Stability Constants" by A. E. Martell and R. M. Smith, vols. 1-4, Plenum Press, NY (1977).

R. D. Hancock and A. E. Martell, Chem. Rev. vol. 89, p. 1875-1914 (1989).

"Stability Constants of Metal-ion Complexes", The Chemical Society, London 1964.

"Polymer Permeability", by J. Comyn, Elsevier, NY 1985.

"Permeability and Other Film Properties of Plastics and Elastomers" Plastics Design Library, NY 1995.

Natrajan et al., "Efficacy of Nisin-Coated Polymer Films to Inactivate *Salmonella typhimurium* on Fresh Broiler Skin", Journal of Food Protection, vol. 63, No. 9, Sep. 2000, pp. 1189-1196, XP009042192.

Cha Dong Su et al., Database Biosis [Online]; Biosciences Information Service, 2002, "Antimicrobial Films Based on Na-alginate and kappa-carrageenan", XP002350316, Database accession No. PREV200300049865.

Hoffman K L et al., Databases Biosis [Online]: Biosciences Information Service, Jun. 2001, "Antimicrobial Effects of Corn Zein Films Impregnated with Nisin, Lauric Acid, and EDTA", XP002350317, Database accession No. PREV200100315943.

* cited by examiner

PACKAGING MATERIAL FOR INHIBITING MICROBIAL GROWTH

CROSS REFERENCE TO RELATED APPLICATIONS

Reference is made to commonly assigned pending U.S. patent application Ser. No. 10/823,446 filed Apr. 13, 2004 entitled CONTAINER FOR INHIBITING MICROBIAL GROWTH IN LIQUID NUTRIENTS by David L. Patton, Joseph F. Bringley, Richard W. Wien, John M. Pochan, Yannick J. F. Lerat; pending U.S. patent application Ser. No. 10/823,443 filed Apr. 13, 2004 entitled USE OF DERIVATIZED NANOPARTICLES TO MINIMIZE GROWTH OF MICRO-ORGANISMS IN HOT FILLED DRINKS by Richard W. Wien, David L. Patton, Joseph F. Bringley, Yannick J. F. Lerat; pending U.S. patent application Ser. No. 10/822,945 filed Apr. 13, 2004 entitled ARTICLE FOR INHIBITING MICROBIAL GROWTH IN PHYSIOLOGICAL FLUIDS by Joseph F. Bringley, David L. Patton, Richard W. Wien, Yannick J. F. Lerat; pending U.S. patent application Ser. No. 10/822,940 filed Apr. 13, 2004 entitled DERIVATIZED NANOPARTICLES COMPRISING METAL-ION SEQUESTRAINT by Joseph F. Bringley; pending U.S. patent application Ser. No. 10/822,929 filed Apr. 13, 2004 entitled COMPOSITION OF MATTER COMPRISING POLYMER AND DERIVATIZED NANOPARTICLES by Joseph F. Bringley, Richard W. Wien, David L. Patton, and pending U.S. patent application Ser. No. 10/822,939 filed Apr. 13, 2004 entitled COMPOSITION COMPRISING INTERCALATED METAL-ION SEQUESTRANTS by Joseph F. Bringley, David L. Patton, Richard W. Wien the disclosures of which are incorporated herein by reference.

FIELD OF THE INVENTION

The present invention relates to an article for inhibiting the growth of micro-organisms in packaged foodstuffs and in liquid nutrients and is capable of removing metals ions from the surfaces of foodstuffs, liquid extrudates of foodstuffs and liquid nutrients.

BACKGROUND OF THE INVENTION

In recent years people have become very concerned about exposure to the hazards of microbe contamination. For example, exposure to certain strains of *Escherichia coli* through the ingestion of under-cooked beef can have fatal consequences. Exposure to *Salmonella enteritidis* through contact with unwashed poultry can cause severe nausea. Mold and yeast (*Candida albicans*) may cause skin infections. In some instances, biocontamination alters the taste of the food or drink or makes the food unappetizing. With the increased concern by consumers, manufacturers have started to produce products having antimicrobial properties. A wide variety of antimicrobial materials have been developed which are able to slow or even stop microbial growth; such materials when applied to consumer items may decrease the risk of infection by micro-organisms.

Noble metal-ions such as silver and gold ions are known for their antimicrobial properties and have been used in medical care for many years to prevent and treat infection. In recent years, this technology has been applied to consumer products to prevent the transmission of infectious disease and to kill harmful bacteria such as *Staphylococcus aureus* and *Salmonella*. In common practice, noble metals, metal-ions, metal salts or compounds containing metal-ions having antimicrobial properties may be applied to surfaces to impart an antimicrobial property to the surface. If, or when, the surface is inoculated with harmful microbes, the antimicrobial metal-ions or metal complexes, if present in effective concentrations, will slow or even prevent altogether the growth of those microbes. Antimicrobial activity is not limited to noble metals but is also observed in organic materials such as chlorophenol compounds (Triclosan™), isothiazolone (Kathon™), antibiotics, and some polymeric materials.

In order for an antimicrobial article to be effective against harmful micro-organisms, the antimicrobial compound must come in direct contact with micro-organisms present in the surrounding environment, such as food, liquid nutrient or biological fluid. This creates a problem in that the surrounding environment may become contaminated with the antimicrobial compounds, which may potentially alter the color or taste of items such as beverages and foodstuffs, and in the worst case may be harmful to the persons using or consuming those items. The wide spread use of antimicrobial materials may cause further problems in that disposal of the items containing these materials cannot be accomplished without impacting the biological health of the landfill or other site of disposal; and further the antimicrobial compounds may leach into surrounding rivers, lakes and water supplies. The wide spread use of antimicrobial materials may cause yet further problems in that micro-organisms may develop resistance to these materials and new infectious microbes and new diseases may develop. It has been recognized that small concentrations of metal-ions may play an important role in biological processes. For example, Mn, Fe, Ca, Zn, Cu and Al are essential bio-metals, and are required for most, if not all, living systems. Metal-ions play a crucial role in oxygen transport in living systems, and regulate the function of genes and replication in many cellular systems. Calcium is an important structural element in the formation of bones and other hard tissues. Mn, Cu and Fe are involved in metabolism and enzymatic processes. At high concentrations, metals may become toxic to living systems and the organism may experience disease or illness if the level cannot be controlled. As a result, the availability and concentrations of metal-ions in aqueous and biological environments is a major factor in determining the abundance, growth-rate and health of plant, animal and micro-organism populations.

It has been recognized that iron is an essential biological element, and that all living organisms require iron for survival and replication. Although the occurrence and concentration of iron is relatively high on the earth's surface, the availability of "free" iron is severely limited by the extreme insolubility of iron in aqueous environments. As a result, many organisms have developed complex methods of procuring "free" iron for survival and replication; and depend directly upon these mechanisms for their survival.

Articles, such as packaging materials, are needed that are able to provide for the general safety and health of the public in a safe and efficient manner. Articles, such as packaging materials, are needed that are able to improve the quality and safety of food supplies for the general public. Food and consumer packaging materials are needed that are able to improve food quality, to increase shelf-life, to protect from microbial contamination, and to do so in a manner that is safe for the user of such items and that is environmentally clean. Materials and methods are needed to prepare articles having antimicrobial properties that are less, or not, susceptible to microbial resistance. Methods are needed that are able to target and remove specific, biologically important, metal-ions while leaving intact the concentrations of beneficial metal-ions.

SUMMARY OF THE INVENTION

In accordance with one aspect of the present invention, there is provided a packaging material used for wrapping foodstuffs and for inhibiting the growth of micro-organisms in foodstuffs, the packaging material having a metal-ion sequestering agent capable of removing designated metals ions from the surfaces of the foodstuffs and from liquid extrudates of foodstuffs.

In accordance with another aspect of the present invention, there is provided a packaging assembly for inhibiting the growth of micro-organisms in foodstuffs, the packaging assembly comprising a tray and absorbent material supported by the tray, the absorbent material having a metal-ion sequestering agent capable of removing designated metals ions for inhibiting the growth of micro-organisms from the surfaces of the foodstuffs and from liquid extrudates of foodstuffs placed on the absorbent material.

In accordance with yet another aspect of the present invention, there is provided a packaging assembly for inhibiting the growth of micro-organisms in foodstuffs, the packaging assembly comprising a tray having a metal-ion sequestering agent capable of removing designated metals ions for inhibiting the growth of micro-organisms from the surfaces of the foodstuffs and from liquid extrudates of foodstuffs placed on the tray, and a thin film provided for sealing the foodstuffs on the tray.

In accordance with still another aspect of the present invention, there is provided a packaging assembly for inhibiting the growth of micro-organisms in foodstuffs, the packaging assembly comprising a tray and absorbent material supported by the tray, the absorbent material having a sequestering agent such that when the absorbent material is placed in contact with the foodstuff the sequestering agent inhibits the growth of microbes from the surfaces of the foodstuffs and from liquid extrudates of foodstuffs placed on the absorbent material.

These and other aspects, objects, features and advantages of the present invention will be more clearly understood and appreciated from a review of the following detailed description of the preferred embodiments and appended claims and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
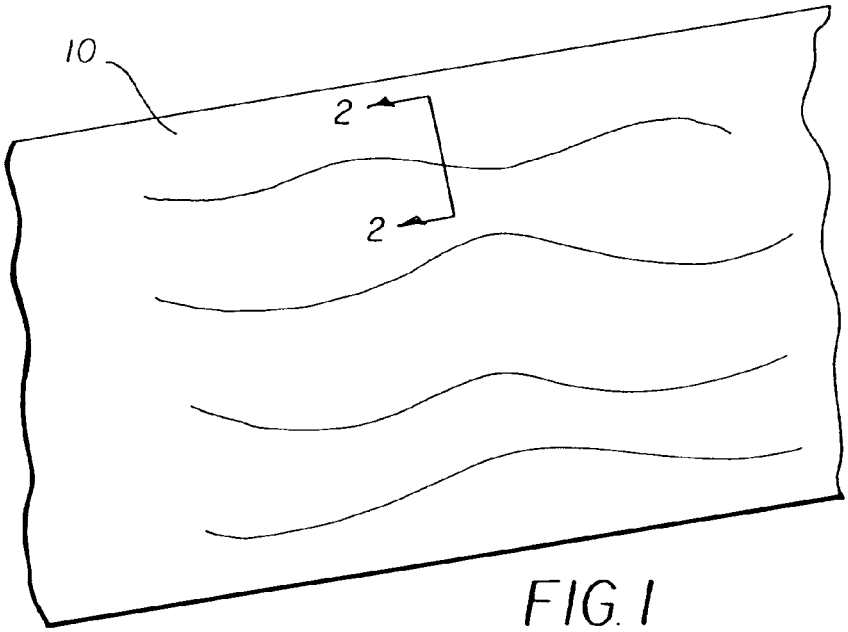
FIG. 1 illustrates a top view of a portion of a flexible packaging material made in accordance with the present invention.

The packaging material of the invention is useful for preserving the freshness and shelf-life of foodstuffs, and for preventing microbial contamination of foodstuffs. The invention may improve the quality and safety of food supplies for the general public. The packaging materials of the invention do not release chemicals that can be harmful to humans or that may leach into aquatic or surrounding environments, and are cleaner and safer in preventing microbial contamination and infectious disease. The packaging materials of the invention are able to remove or sequester metal-ions such as Zn, Cu, Mn and Fe which are essential for biological growth, and thus may inhibit the growth of harmful micro-organisms such as bacteria, viruses, and fungi on the surfaces of foodstuffs, or in liquid extrudates of foodstuffs. The invention "starves" the micro-organisms of minute quantities of essential nutrients (metal-ions) and hence limits their growth and reduces the risk due to bacterial, viral and other infectious diseases. The invention further inhibits the growth of yeast, mold, fungi etc. on the surfaces of foodstuffs and in liquid extrudates of foodstuffs and thus increases the shelf-life of foods.

The invention provides a packaging material used for wrapping foodstuffs and for inhibiting the growth of micro-organisms in foodstuffs, said packaging material having a metal-ion sequestering agent capable of removing designated metals ions from the surfaces of said foodstuffs and from liquid extrudates of foodstuffs. In a preferred embodiment the sequestering agent is immobilized on a support structure and has a stability constant for iron (III) greater than $10^{10}$. This is preferred because iron is an essential metal-ion nutrient for virtually all micro-organisms. The term stability constant will be defined in detail below. It is preferred that the sequestering agent is immobilized onto the packaging material, or onto the support structure of the packaging material. In this manner, metal-ions important for biological growth may be sequestered or trapped on, or just below, the surface of the support structure by the immobilized sequestering agent. The trapped metal-ions are then unavailable to micro-organisms that require them for growth. It is preferred that the support structure is made of glass, metal, plastic, paper, or wood, since these materials are commonly used to contain foodstuffs.

It is preferred that the packaging material comprises a polymer containing said metal-ion sequestrant. The packing material may comprise the polymer itself containing said metal-ion sequestrant, or alternatively, the metal-ion sequestrant may be contained with a polymeric layer attached to a support structure. It is preferred that said polymer is permeable to water. It is important that the polymer is permeable to water because permeability facilitates the contact of the target metal-ions with the metal-ion sequestrant, which, in turn, facilitates the sequestration of the metal-ions within the polymer or polymeric layer. A measure of the permeability of various polymeric addenda to water is given by the permeability coefficient, P which is given by $$P=(\text{quantity of permeate})(\text{film thickness})/[\text{area}\times\text{time}\times(\text{pressure drop across the film})]$$

Permeability coefficients and diffusion data of water for various polymers are discussed by J. Comyn, in *Polymer Permeability*, Elsevier, N.Y., 1985 and in "Permeability and Other Film Properties Of Plastics and Elastomers", Plastics Design Library, NY, 1995. The higher the permeability coefficient, the greater the water permeability of the polymeric media. The permeability coefficient of a particular polymer may vary depending upon the density, crystallinity, molecular weight, degree of cross-linking, and the presence of addenda such as coating-aids, plasticizers, etc. It is preferred that the polymer has a water permeability of greater than 1000 $[(cm^3\ cm)/(cm^2 sec/Pa)]\times10^{13}$. It is further preferred that the polymer has a water permeability of greater than 5000 $[(cm^3 cm)/(cm^2 sec/Pa)]\times10^{13}$. Preferred polymers for practice of the invention are polyvinyl alcohol, cellophane, water-based polyurethanes, polyester, nylon, high nitrile resins, polyethylene-polyvinyl alcohol copolymer, polystyrene, ethyl cellulose, cellulose acetate, cellulose nitrate, aqueous latexes, polyacrylic acid, polystyrene sulfonate, polyamide, polymethacrylate, polyethylene terephthalate, polystyrene, polyethylene, polypropylene or polyacrylonitrile. It is preferred that the metal-ion sequestrant comprises 0.1 to 50.0% by weight of the polymer, and more preferably 1% to 10% by weight of the polymer.

In a preferred embodiment, the packaging material comprises a plurality of layers having an outer layer having a metal-ion sequestering agent. In another preferred embodiment, the packaging material comprises a plurality of layers comprising an outer barrier layer for contact with said foodstuff and an inner layer having said sequestering agent, said inner layer having a first side adjacent said barrier layer, and said barrier layer allowing liquid to pass through to said inner layer. Multiple layers may be necessary to provide a rigid structure, able to contain foodstuffs, and to provide physical robustness. In a particular case there may be provided a second outer layer on the second side of said inner layer. It is preferred that both the first and second outer layer comprise a barrier layer that allows liquid to pass through to said inner layer. The barrier layer does not contain the metal-ion sequestrant. The barrier layer may provide several functions including improving the physical strength and toughness of the article and resistance to scratching, marring, cracking, etc. However, the primary purpose of the barrier layer is to provide a barrier through which micro-organisms cannot pass. It is important to limit, or eliminate, the direct contact of micro-organisms with the metal-ion sequestrant or the layer containing the metal-ion sequestrant, since many micro-organisms, under conditions of iron deficiency, may bio-synthesize molecules which are strong chelators for iron, and other metals. These bio-synthetic molecules are called "siderophores" and their primary purpose is to procure iron for the micro-organisms. Thus, if the micro-organisms are allowed to directly contact the metal-ion sequestrant, they may find a rich source of iron there, and begin to colonize directly at these surfaces. The siderophores produced by the micro-organisms may compete with the metal-ion sequestrant for the iron (or other bio-essential metal) at their surfaces. The barrier layer of the invention does not contain the metal-ion sequestrant, and because micro-organisms are large, they may not pass or diffuse through the barrier layer. The barrier layer thus prevents contact of the micro-organisms with the polymeric layer containing the metal-ion sequestrant of the invention.

It is preferred that the barrier layer is permeable to water. This is preferred because metal-ions in solution may then readily diffuse through the barrier layer and become sequestered in the underlying polymeric layer containing the metal-ion sequestrant. Thus, the barrier layer spatially separates the micro-organisms from the polymeric sequestration layer. It is preferred that the polymer(s) of the barrier layer has a water permeability of greater than 1000 $[(cm^3 cm)/(cm^2 sec/Pa)]\times1013$. It is further preferred that the polymer(s) of the barrier layer has a water permeability of greater than 5000 $[(cm\ 3\ cm)/(cm^2 sec/Pa)]\times10^{13}$. Preferred polymers for use in the barrier layer are one or more of polyvinyl alcohol, cellophane, water-based polyurethanes, polyester, nylon, high nitrile resins, polyethylene-polyvinyl alcohol copolymer, polystyrene, ethyl cellulose, cellulose acetate, cellulose nitrate, aqueous latexes, polyacrylic acid, polystyrene sulfonate, polyamide, polymethacrylate, polyethylene terephthalate, polystyrene, polyethylene, polypropylene, or polyacrylonitrile or copolymers thereof. It is preferred that the barrier layer has a thickness in the range of 0.1 microns to 10.0 microns.

The packaging material of the invention comprises a metal-ion sequestrant having a high-affinity for metal-ions. It is preferred that the metal-ion sequestrant has a high-affinity for biologically important metal-ions such as Mn, Zn, Cu and Fe. It is further preferred that the metal-ion sequestering agent is immobilized on the support structure and has a high-selectivity for biologically important metal-ions such as Mn, Zn, Cu and Fe.

A measure of the "affinity" of metal-ion sequestrants for various metal-ions is given by the stability constant (also often referred to as critical stability constants, complex formation constants, equilibrium constants, or formation constants) of that sequestrant for a given metal-ion. Stability constants are discussed at length in "Critical Stability Constants", A. E. Martell and R. M. Smith, Vols. 1-4, Plenum, N.Y. (1977), "Inorganic Chemistry in Biology and Medicine", Chapter 17, ACS Symposium Series, Washington, D.C. (1980), and by R. D. Hancock and A. E. Martell, Chem. Rev. vol. 89, p. 1875-1914 (1989). The ability of a specific molecule or ligand to sequester a metal-ion may depend also upon the pH, the concentrations of interfering ions, and the rate of complex formation (kinetics). Generally, however, the greater the stability constant, the greater the binding affinity for that particular metal-ion. Often the stability constants are expressed as the natural logarithm of the stability constant. Herein the stability constant for the reaction of a metal-ion (M) and a sequestrant or ligand (L) is defined as follows:

$$M+nL \leftrightharpoons ML_n$$

where the stability constant is $\beta_n=[ML_n]/[M][L]^n$, wherein $[ML_n]$ is the concentration of "complexed" metal-ion, [M] is the concentration of free (uncomplexed) metal-ion and [L] is the concentration of free ligand. The log of the stability constant is log $\beta_n$, and n is the number of ligands which coordinate with the metal. It follows from the above equation that if $\beta_n$ is very large, the concentration of "free" metal-ion will be very low. Ligands with a high stability constant (or affinity) generally have a stability constant greater than $10^{10}$ or a log stability constant greater than 10 for the target metal. Preferably the ligands have a stability constant greater than $10^{15}$ for the target metal-ion. Table 1 lists common ligands (or sequestrants) and the natural logarithm of their stability constants (log $\beta_n$) for selected metal-ions.

TABLE 1

Common ligands (or sequestrants) and the natural logarithm of their stability constants (log $\beta_n$) for selected metal-ions.

| Ligand | Ca | Mg | Cu(II) | Fe(III) | Al | Ag | Zn |
|---|---|---|---|---|---|---|---|
| alpha-amino carboxylates | | | | | | | |
| EDTA | 10.6 | 8.8 | 18.7 | 25.1 | | 7.2 | 16.4 |
| DTPA | 10.8 | 9.3 | 21.4 | 28.0 | 18.7 | 8.1 | 15.1 |
| CDTA | 13.2 | | 21.9 | 30.0 | | | |
| NTA | | | | 24.3 | | | |
| DPTA | 6.7 | 5.3 | 17.2 | 20.1 | 18.7 | 5.3 | |
| PDTA | 7.3 | | 18.8 | | | | 15.2 |
| citric Acid | 3.50 | 3.37 | 5.9 | 11.5 | 7.98 | 9.9 | |
| salicylic acid | | | | 35.3 | | | |
| Hydroxamates | | | | | | | |
| Desferrioxamine B | | | | 30.6 | | | |
| acetohydroxamic acid | | | | 28 | | | |
| Catechols | | | | | | | |
| 1,8-dihydroxy naphthalene 3,6 sulfonic acid | | | | 37 | | | |
| MECAMS | | | | 44 | | | |
| 4-LICAMS | | | | 27.4 | | | |
| 3,4-LICAMS | 16.2 | | | 43 | | | |
| 8-hydroxyquinoline | | | | 36.9 | | | |
| disulfocatechol | 5.8 | 6.9 | 14.3 | 20.4 | 16.6 | | |

EDTA is ehtylenediamine tetraacetic acid and salts thereof, DTPA is diethylenetriaminepentaacetic acid and salts thereof, DPTA is Hydroxylpropylenediaminetetraacetic acid and salts thereof, NTA is nitrilotriacetic acid and salts thereof, CDTA is 1,2-cyclohexanediamine tetraacetic acid and salts thereof, PDTA is propylenediammine tetraacetic acid and salts thereof. Desferrioxamine B is a commercially available iron chelating drug, desferal®. MECAMS, 4-LICAMS and 3,4-LICAMS are described by Raymond et al. in "Inorganic Chemistry in Biology and Medicine", Chapter 18, ACS Symposium Series, Washington, D.C. (1980). Log stability constants are from "Critical Stability Constants", A. E. Martell and R. M. Smith, Vols. 1-4, Plenum Press, NY (1977); "Inorganic Chemistry in Biology and Medicine", Chapter 17, ACS Symposium Series, Washington, D.C. (1980); R. D. Hancock and A. E. Martell, Chem. Rev. vol. 89, p. 1875-1914 (1989) and "Stability Constants of Metal-ion Complexes", The Chemical Society, London, 1964.

In many instances, the growth of a particular microorganism may be limited by the availability of a particular metal-ion, for example, due to a deficiency of this metal-ion. In such cases, it is desirable to select a metal-ion sequestrant with a very high specificity or selectivity for a given metal-ion. Metal-ion sequestrants of this nature may be used to control the concentration of the target metal-ion and thus limit the growth of the organism(s) which require this metal-ion. However, it may be necessary to control the concentration of the target metal, without affecting the concentrations of beneficial metal-ions such as potassium and calcium. One skilled in the art may select a metal-ion sequestrant having a high selectivity for the target metal-ion. The selectivity of a metal-ion sequestrant for a target metal-ion is given by the difference between the log of the stability constant for the target metal-ion, and the log of the stability constant for the interfering (beneficial) metal-ions. For example, if a treatment required the removal of Fe(III), but it was necessary to leave the Ca-concentration unaltered, then from Table 1, DTPA would be a suitable choice since the difference between the log stability constants 28-10.8=17.2, is very large. 3,4-LICAMS would be a still more suitable choice since the difference between the log stability constants 43-16.2=26.8, is the largest in Table 1.

It is preferred that said metal-ion sequestrant has a high-affinity for iron, and in particular iron(III). It is preferred that the stability constant of the sequestrant for iron(III) be greater than $10^{10}$. It is still further preferred that the metal-ion sequestrant has a stability constant for iron greater than $10^{20}$. It is still further preferred that the metal-ion sequestrant has a stability constant for iron greater than $10^{30}$.

In a preferred embodiment the packaging material comprises denvatized nanoparticles comprising inorganic nanoparticles having an attached metal-ion sequestrant, wherein said inorganic nanoparticles have an average particle size of less than 200 nm and the derivatized nanoparticles have a stability constant greater than $10^{10}$ with iron (III). It is further preferred that the derivatized nanoparticles have a stability constant greater than $10^{20}$ with iron (III). The derivatized nanoparticles are preferred because they have very high surface area and may have a very high-affinity for the target metal-ions. It is preferred that the nanoparticles have an average particle size of less than 100 nm. It is further preferred that the nanoparticles have an average size of less than 50 nm, and most preferably less than 20 nm. Preferably greater than 95% by weight of the nanoparticles are less than 200 nm, more preferably less than 100 nm, and most preferably less than 50 nm. This is preferred because as the particle size becomes smaller, the particles scatter visible-light less strongly. Therefore, the derivatized nanoparticles can be applied to clear, transparent surfaces without causing a hazy or a cloudy appearance at the surface. This allows the particles of the present invention to be applied to packaging materials without changing the appearance of the item. It is preferred that the nanoparticles have a very high surface area, since this provides more surface with which to covalently bind the metal-ion sequestrant, thus improving the capacity of the derivatized nanoparticles for binding metal-ions. It is preferred that the nanoparticles have a specific surface area of greater than 100 $m^2/g$, more preferably greater than 200 $m^2/g$, and most preferably greater than 300 $m^2/g$. For applications of the invention in which the concentrations of contaminant or targeted metal-ions in the environment is high, it is preferred that the nanoparticles have a particle size of less than 20 nm and a surface area of greater than 300 $m^2/g$. Derivatized nanoparticles are described at length in pending U.S. patent application Ser. No. 10/822,940 filed Apr. 13, 2004 entitled DERIVATIZED NANOPARTICLES COMPRISING METAL-ION SEQUESTRAINT by Joseph F. Bringley.

The inorganic nanoparticles of the invention preferably comprise silica oxides, alumina oxides, boehmites, titanium oxides, zinc oxides, tin oxides, zirconium oxides, yttrium oxides, hafnium oxides, clays or alumina silicates, and more preferably comprise silicon dioxide, alumina oxide, clays or boehmite. The nanoparticles may comprise a combination or mixture of the above materials. The term "clay" is used to describe silicates and alumino-silicates, and derivatives thereof. Some examples of clays which are commercially available are montmorrillonite, hectorite, and synthetic derivatives such as laponite. Other examples include hydrotalcites, zeolites, alumino-silicates, and metal (oxy)hydroxides given by the general formula, $M_aO_b(OH)_c$, where M is a metal-ion and a, b and c are integers.

It is preferred that the derivatized nanoparticles have a high stability constant for the target metal-ion(s). The stability constant for the derivatized nanoparticle will largely be determined by the stability constant for the attached metal-ion sequestrant. However, the stability constant for the derivatized nanoparticles may vary somewhat from that of the attached metal-ion sequestrant.

Generally, it is anticipated that metal-ion sequestrants with high stability constants will give derivatized nanoparticles with high stability constants. For a particular application, it may be desirable to have a derivatized nanoparticle with a high selectivity for a particular metal-ion. In most cases, the derivatized nanoparticle will have a high selectivity for a particular metal-ion if the stability constant for that metal-ion is about $10^6$ greater than for other ions present in the system.

Metal-ion sequestrants may be chosen from various organic molecules. Such molecules having the ability to form complexes with metal-ions are often referred to as "chelators", "complexing agents", and "ligands". Certain types of organic functional groups are known to be strong "chelators" or sequestrants of metal-ions. It is preferred that the sequestrants of the invention contain alpha-amino carboxylates, hydroxamates, or catechol, functional groups. Hydroxamates, or catechol, functional groups are preferred. Alpha-amino carboxylates have the general formula:

$$R—[N(CH_2CO_2M)—(CH_2)_n—N(CH_2CO_2M)_2]_x$$

where R is an organic group such as an alkyl or aryl group; M is H, or an alkali or alkaline earth metal such as Na, K, Ca or Mg, or Zn; n is an integer from 1 to 6; and x is an integer from 1 to 3. Examples of metal-ion sequestrants containing alpha-amino carboxylate functional groups include ethylenediaminetetraacetic acid (EDTA), ethylenediaminetetraacetic acid disodium salt, diethylenetriaminepentaacetic acid (DTPA), Hydroxylpropylenediaminetetraacetic acid (DPTA), nitrilotriacetic acid, triethylenetetraaminehexaacetic acid, N,N-bis(o-hydroxybenzyl) ethylenediamine-N,N' diacteic acid, and ethylenebis-N,N'-(2-o-hydroxyphenyl)glycine.

Hydroxamates (or often called hydroxamic acids) have the general formula:

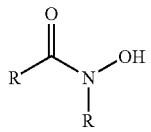

where R is an organic group such as an alkyl or aryl group. Examples of metal-ion sequestrants containing hydroxamate functional groups include acetohydroxamic acid, and desferroxamine B, the iron chelating drug desferal.

Catechols have the general formula:

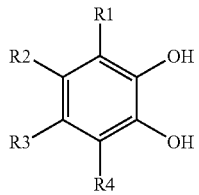

Where R1, R2, R3 and R4 may be H, an organic group such as an alkyl or aryl group, or a carboxylate or sulfonate group. Examples of metal-ion sequestrants containing catechol functional groups include catechol, disulfocatechol, dimethyl-2,3-dihydroxybenzamide, mesitylene catecholamide (MECAM) and derivatives thereof, 1,8-dihydroxynaphthalene-3,6-sulfonic acid, and 2,3-dihydroxynaphthalene-6-sulfonic acid.

In an embodiment, the metal-ion sequestrant is attached to a nanoparticle by reacting the nanoparticle with a metal alkoxide intermediate of the sequestrant having the general formula: $M(OR)_{4-x}R'_x$: wherein M is silicon, titanium, aluminum, tin, or germanium; x is an integer from 1 to 3; R is an organic group; and R' is an organic group containing an alpha amino carboxylate, a hydroxamate, or a catechol.

In a preferred embodiment, the metal-ion sequestrant is attached to a nanoparticle by reaction of the nanoparticle with a silicon alkoxide intermediate having the general formula:

$$Si(OR)_{4-x}R'_x;$$

wherein x is an integer from 1 to 3;

R is an alkyl group; and

R' is an organic group containing an alpha amino carboxylate, a hydroxamate, or a catechol. The —OR-group attaches the silicon alkoxide to the core particle surface via a hydrolysis reaction with the surface of the particles. Materials suitable for practice of the invention include N-(trimethoxysilylpropyl)ethylenediamine triacetic acid, trisodium salt, N-(triethoxysilylpropyl)ethylenediamine tri acetic acid, tri sodium salt, N-(trimethoxysilylpropyl)ethylenediamine triacetic acid, N-(trimethoxysilylpropyl)diethylenetriamine tetra acetic acid, N-(trimethoxysilylpropyl) amine diacetic acid, and metal-ion salts thereof.

It is preferred that substantially all (greater than 90%) of the metal-ion sequestrant is covalently bound to the nanoparticles, and is thus "anchored" to the nanoparticle. Metal-ion sequestrant that is not bound to the nanoparticles may dissolve and quickly diffuse through a system, and may be ineffective in removing metal-ions from the system. It is further preferred that the metal-ion sequestrant is present in an amount sufficient, or less than sufficient, to cover the surfaces of all nanoparticles. This is preferred because it maximizes the number of covalently bound metal-ion sequestrants, since once the surface of the nanoparticles is covered, no more covalent linkages to the nanoparticle may result.

The packaging materials of the invention may take many forms including films, wraps, containers, trays, lids, caps, cans, etc. The metal-ion sequestrant may be integrally formed as part of the packaging material. In a preferred embodiment, the packing material is formed as rigid or semi-rigid structure for holding of said foodstuff. It is preferred that said rigid or semi-rigid structure is substantially in the shape of a tray having a substantially continuous outer raised periphery. This is preferred because it may hold the liquid extrudates of foodstuffs within the tray so that the materials of the invention may sequester the target metal-ions. In another embodiment, it is preferred that the packaging material is in the form of a flexible sheet that can be wrapped about foodstuffs. The invention may also provide a packaging assembly for inhibiting the growth of micro-organisms in foodstuffs, wherein the packaging assembly comprising a tray and absorbent material supported by said tray, said absorbent material having a metal-ion sequestering agent capable of removing designated metal-ions for inhibiting the growth of micro-organisms from the surfaces of said foodstuffs and from liquid extrudates of foodstuffs placed on said absorbent material. It is preferred that the absorbent material comprises a first inner absorbent layer placed within an outer layer, said outer layer allowing liquid to pass to said inner absorbent layer. Preferably, the inner absorbent layer contains a metal-ion sequestrant and the outer layer comprises a barrier layer as defined above. It is also preferred that the packaging assembly provides an outer layer comprising a first ply layer and a second ply layer that are secured about their periphery so as to form a pocket in which said inner layer is provided. The packaging assembly may further comprise a thin film provided for sealing said foodstuffs on said tray.

Figure 2:
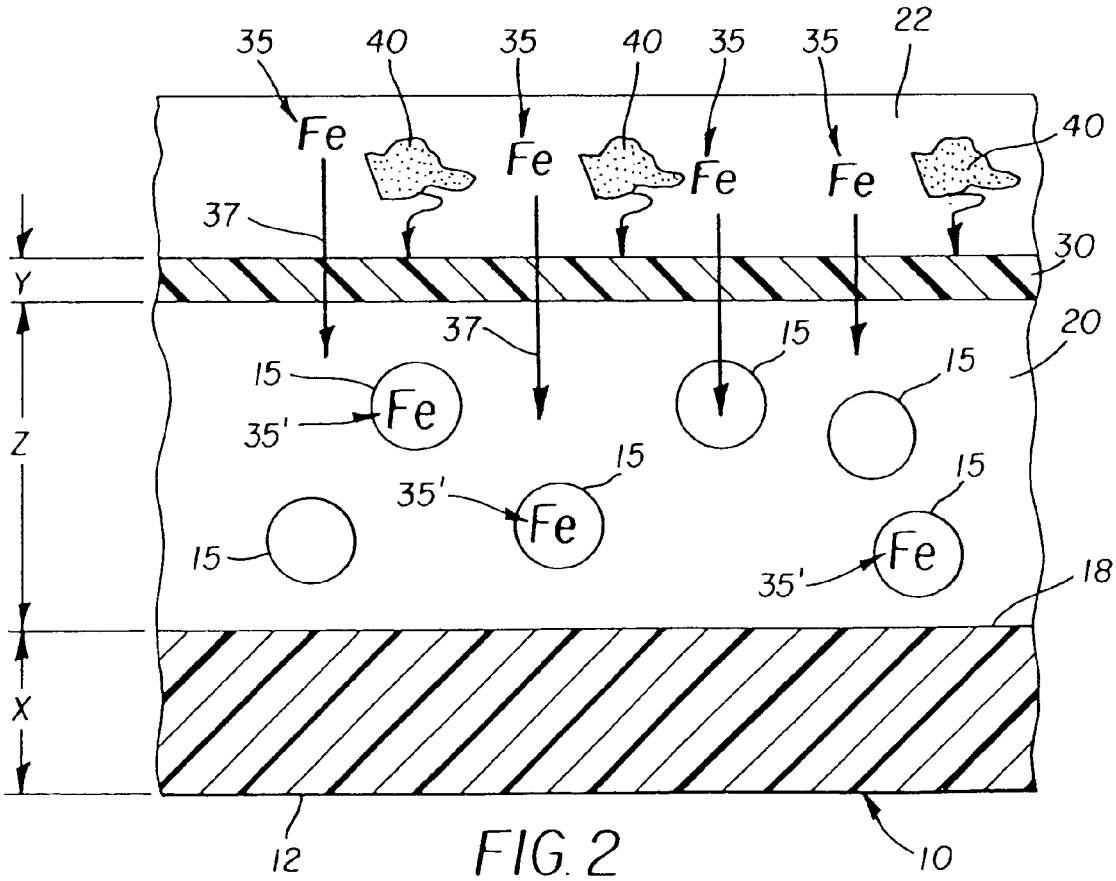
FIG. 2 is enlarged partial cross sectional view of a portion of the packaging material of FIG. 1 as taken along line 2-2.

FIGS. 1 and 2 illustrate a packaging material 10, such as a plastic wrap, made in accordance with the present invention. FIG. 2 illustrates an enlarged cross-sectional view of plastic wrap 10 of FIG. 1, comprising a support layer 12 with a metal-ion sequestrant such as EDTA in the form of a derivatized nanoparticle 15 as described above in a polymeric layer 20 coated on the top surface 18 of the support layer 12. The support layer 12 can be a flexible substrate, which in the embodiment illustrated, has a thickness "x" of between 0.025 millimeters and 5.0 millimeters. In the embodiment illustrated, the thickness x is about 0.125 millimeters. It is, of course, to be understood that thickness of layer 12 may be varied as appropriate. Examples of supports useful for practice of the invention are resin-coated paper, paper, polyesters, or micro porous materials such as polyethylene polymer-containing material sold by PPG Industries, Inc., Pittsburgh, Pa. under the trade name of Teslin®, Tyvek ® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly (butylene terephthalate), and copolymers thereof; polyimides; polyamides; polycarbonates; polystyrene; polyolefins, such as polyethylene or polypropylene; polysulfones; polyacrylates; polyether imides; and mixtures thereof. The papers listed above include a broad range of papers from high end papers, such as photographic paper, to low end papers, such as newsprint. Another example of supports useful for practice of the invention are fabrics such as wools, cotton, polyesters, etc.

The metal-ion sequestrant 15 is immobilized in the polymeric layer 20 located between the support 12 and a barrier layer 30. In order for the metal-ion sequestrant 15 to work properly, the inner polymeric layer 20 containing the metal-ion sequestrant 15 must be permeable to water. Preferred polymers for the polymeric layer 20 containing the metal-ion sequestrant 15 and the barrier layer 30 of the invention are polyvinyl alcohol, cellophane, water-based polyurethanes, polyester, nylon, high nitrile resins, polyethylene-polyvinyl alcohol copolymer, polystyrene, ethyl cellulose, cellulose acetate, cellulose nitrate, aqueous latexes, polyacrylic acid, polystyrene sulfonate, polyamide, polymethacrylate, polyethylene terephthalate, polystyrene, polyethylene, polypropylene or polyacrylonitrile. A water permeable polymer permits water of an adjacent liquid 22 to move freely through the polymeric layer 20 allowing the "free" iron ion 35 as indicated by the arrows 37 to reach and be captured by the metal-ion sequestrant 15. An additional barrier 30 may be used to prevent the micro-organisms 40 from reaching the "free" iron ion 35 captured by the metal-ion sequestrant 15 in the inner polymeric layer 20. The metal-ion sequestrant with a sequestered metal-ion is indicated by numeral 35'. Like the inner polymeric layer 20, the barrier layer 30 must be made of a water permeable polymer as previously described. The micro-organism 40 is too large to pass through the barrier layer 30 or the polymeric layer 20 so it cannot reach the sequestered iron ion 35' now held by the metal-ion sequestrant 15. It is preferred that the barrier layer 30 has a thickness "y" in the range of 0.1 microns to 10.0 microns. It is preferred that microbes are unable to penetrate, to diffuse or pass through the barrier layer 30. The layer 20 preferably has a thickness "z" sufficient to remove the desired amount of free metal ions. In the embodiment illustrated, the thickness "z" is in the range between 0.025 millimeters and 5.0 millimeters. By using the metal-ion sequestrants 15 or metal-ion sequestrants in the form of a derivatized particle 15 to significantly reduce the amount of "free" iron ions 35, the growth of micro-organism 40 is eliminated or significantly reduced. The plastic wrap 10 may be, for example, in the form of a web or a sheet.

Figure 3A:
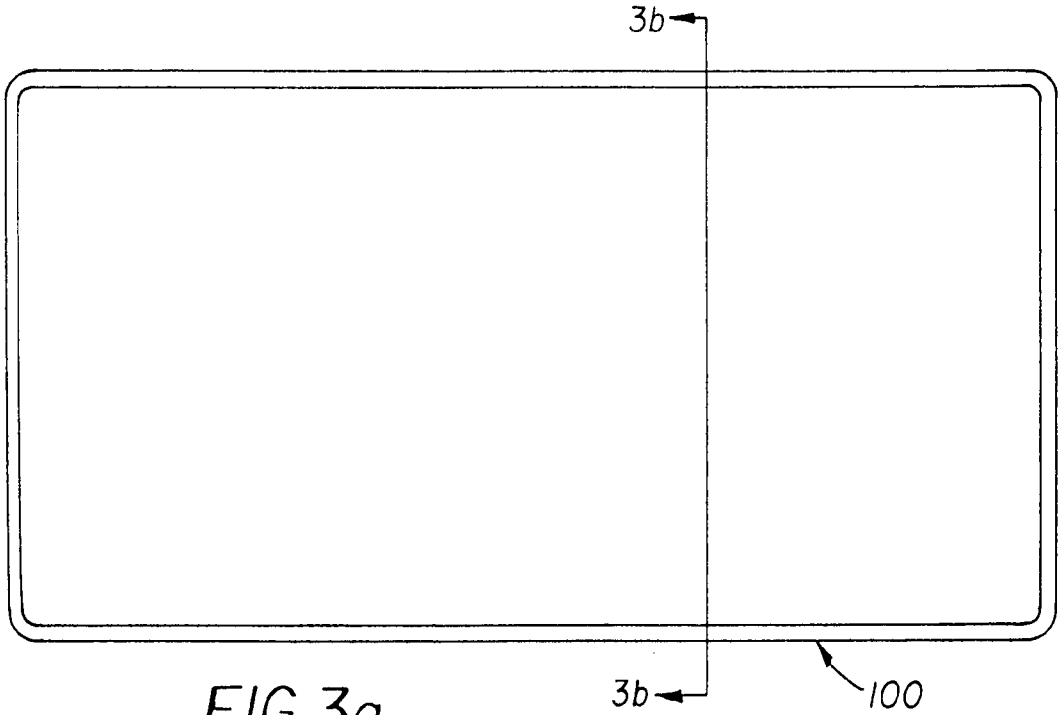
FIG. 3*a* is top plan view of a rigid packaging material made in accordance with the present invention.
Figure 3B:
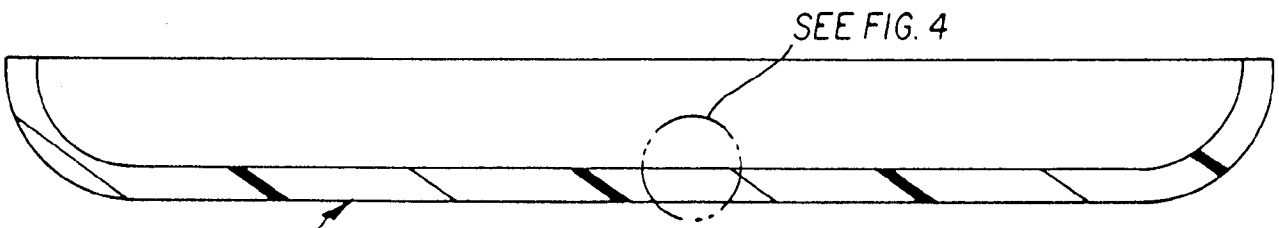
FIG. 3*b* illustrates a cross sectional view of the rigid packaging material of FIG. 3*a* as taken along line 3-3.
Figure 4:
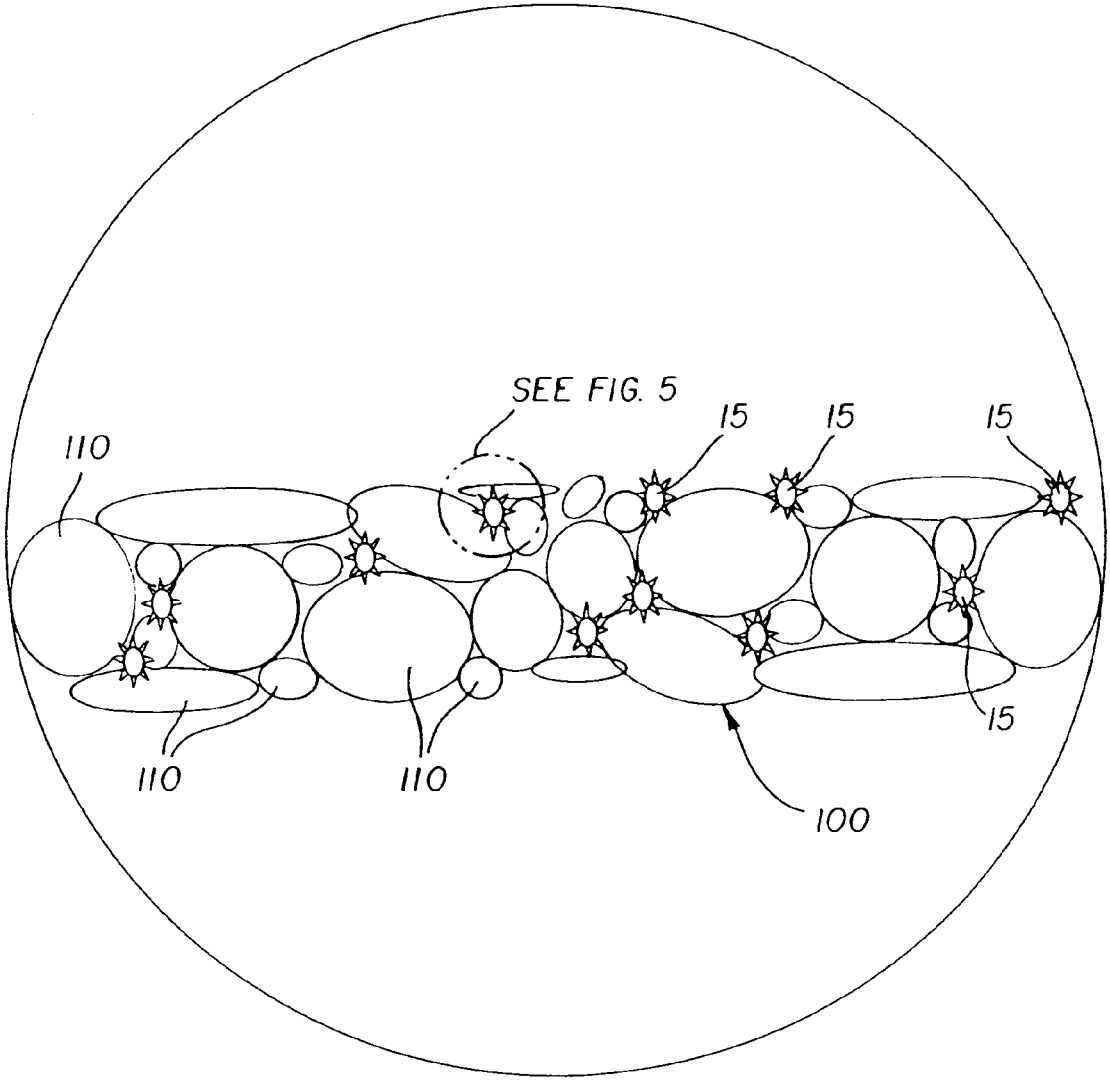
FIG. 4 is an enlarged cross sectional view of a portion of the rigid packaging material of FIG. 3*b* as identified by circle 4.
Figure 5:
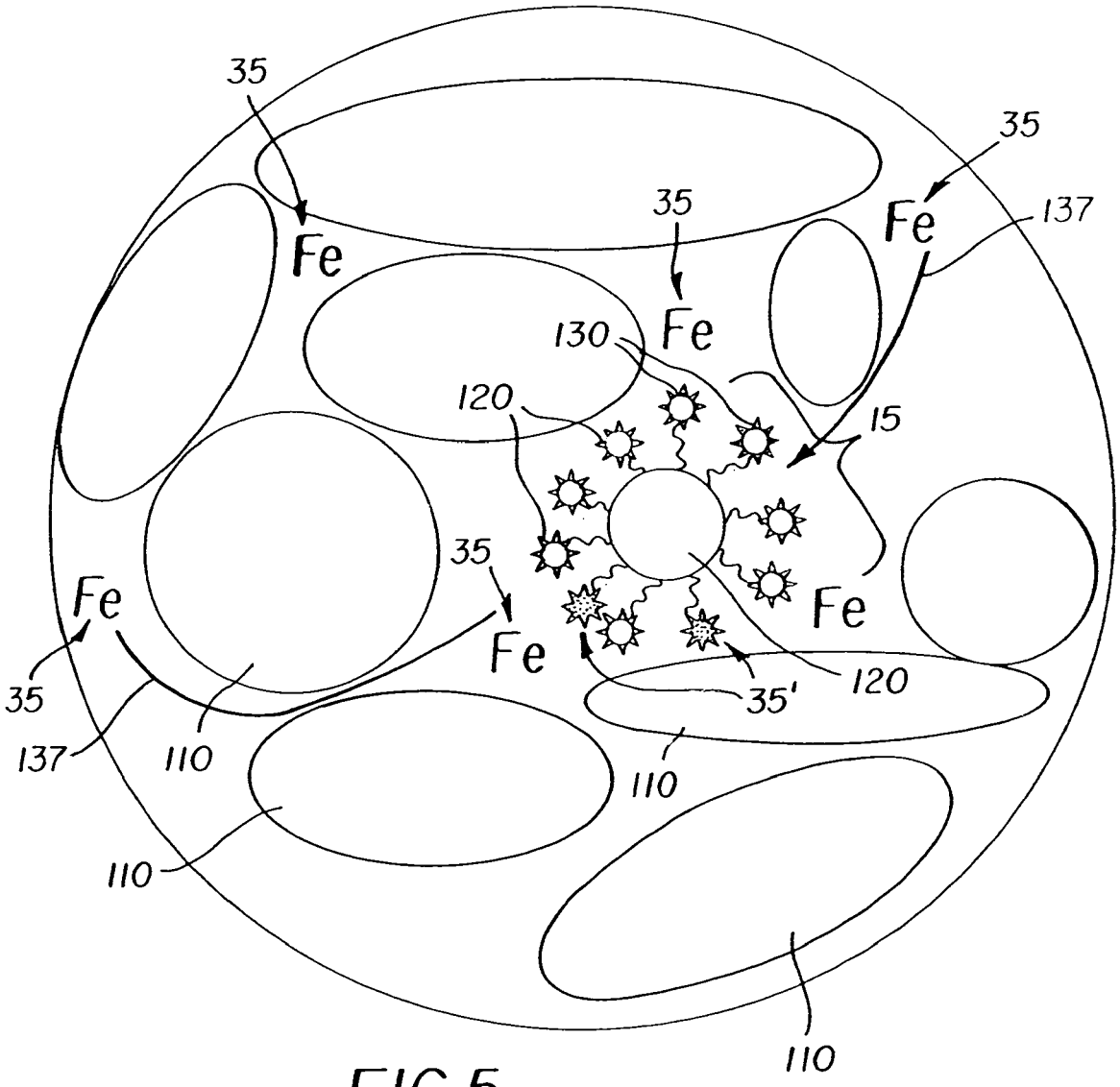
FIG. 5 is yet further an enlarged partial cross sectional view of a portion of the rigid packaging material of FIG. 4 as identified by circle 4.

Now referring to FIGS. 3*a* and 3*b*, there is illustrated a side view of a rigid packaging material formed into a polystyrene tray 100 made in accordance with the present invention. FIG. 4 illustrates an enlarged partial cross-sectional view of the polystyrene tray 100 of FIG. 3. FIG. 5 illustrates yet a further enlarged partial cross-sectional view of FIG. 4. Now referring to FIGS. 4 and 5, the polystyrene tray 100 incorporates a polystyrene material 110 containing derivatized particles 15 comprising an inorganic core material 120 and a shell material 130 made of the metal-ion sequestering agent such as EDTA as described above and in pending U.S. patent application Ser. No. 10/822,940 filed Apr. 13, 2004 entitled DERIVATIZED NANOPARTICLES COMPRISING METAL-ION SEQUESTRAINT by Joseph F. Bringley. The "free" iron ion 35 as indicated by the arrows 137 move to reach and be captured by the derivatized particle 15.

Figure 6:
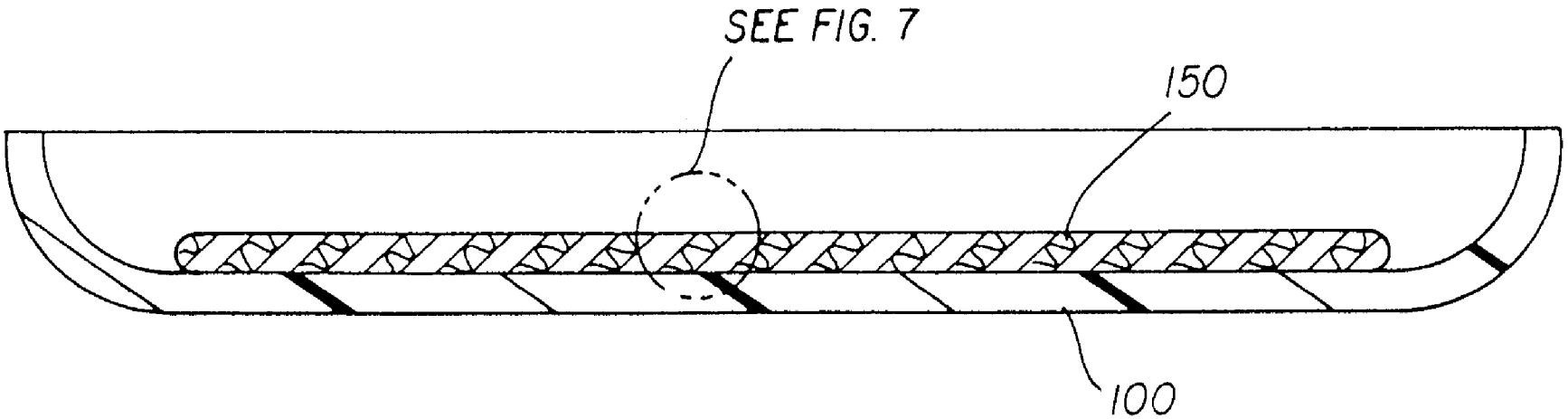
FIG. 6 illustrates a side view of a rigid packaging material similar to FIG. 3 that further includes a liquid absorbing pad made in accordance with the present invention.
Figure 7:
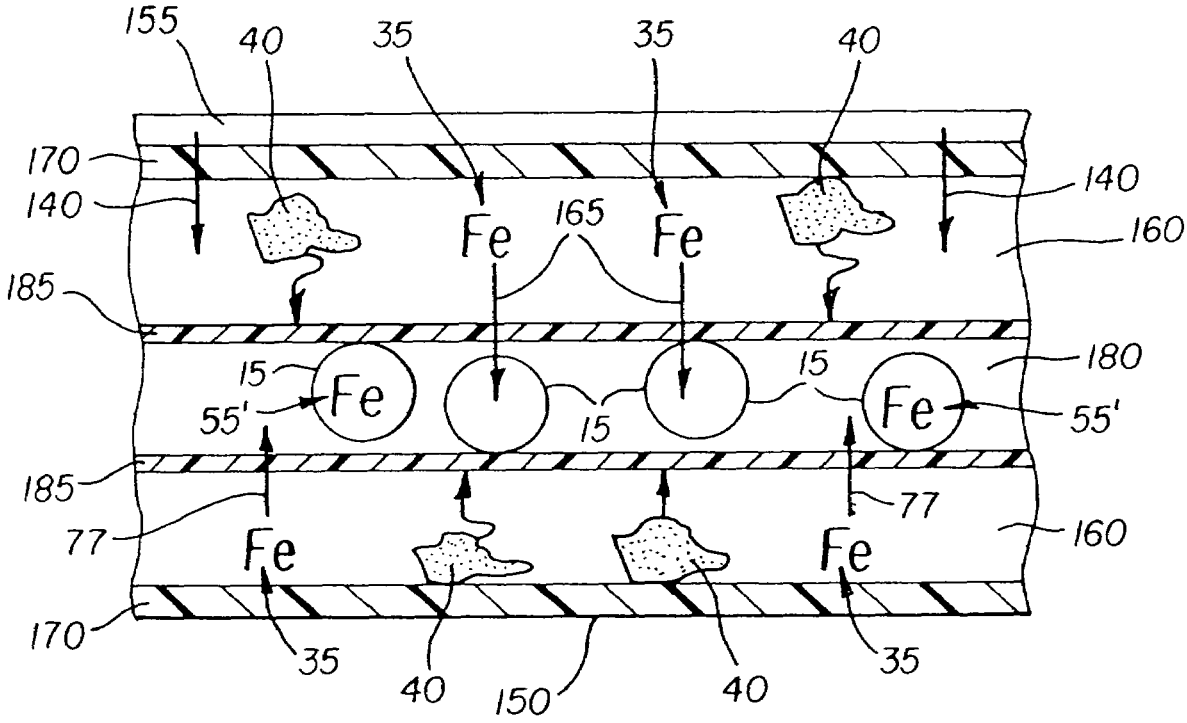
FIG. 7 is an enlarged partial cross sectional view of a portion identified by circle D of the pad of FIG. 6.

FIGS. 6 and 7 show a side view of the polystyrene tray 100 of FIG. 3*b* with a liquid absorbing pad 150 made in accordance with the present invention.

Referring in particular to FIG. 7, there is illustrated an enlarged sectioned view of the liquid absorbing pad 150 shown in 6. The liquid absorbing pad 150 absorbs the liquid extrudates 155 from a food product, such as meat, poultry or fish 200 or other type of foodstuff, shown in FIG. 8, which has been placed on the pad 150. The liquid absorbing pad 150 consists of a number of fibrous layers, such as inner layer 160 and outer layer 170. The derivatized particle, 15 as previously described, are immobilized in an inner polymer 180 disposed or incorporated in the fibrous absorbent pad 150 and may be surrounded by a barrier layer 185. In order for the derivatized particles 15 to work properly, the inner polymer 180 containing the derivatized particles 15 must be permeable to water. Preferred polymers for layers 180 and 185 of the invention have been previously described. The liquid extrudates 155 travel through the barrier layer 185 as indicated by the arrows 140 and absorbed by the fibrous layers 160 and 170. A water permeable polymer permits water to move freely through the polymer 180 allowing the "free" iron ion 35 to reach and be captured by the derivatized particle 15 as indicated by the arrows 165. An additional barrier 185 maybe used to prevent the micro-organism 40 from reaching the inner polymer material 180 containing the derivatized particles 15. Like the inner polymer material 180, the inner barrier layer 185 must be made of a water permeable polymer as previously described. The micro-organism 40 is too large to pass through the barrier 185 or the polymer 180 so it cannot reach the sequestered iron ion 35' now held by the derivatized particles 15. By using the derivatized particles 15 to significantly reduce the amount of "free" iron ions 35 in the liquid extrudates 155 captured by the pad 150, the growth of the micro-organism 40 is eliminated or significantly reduced.

Figure 8:
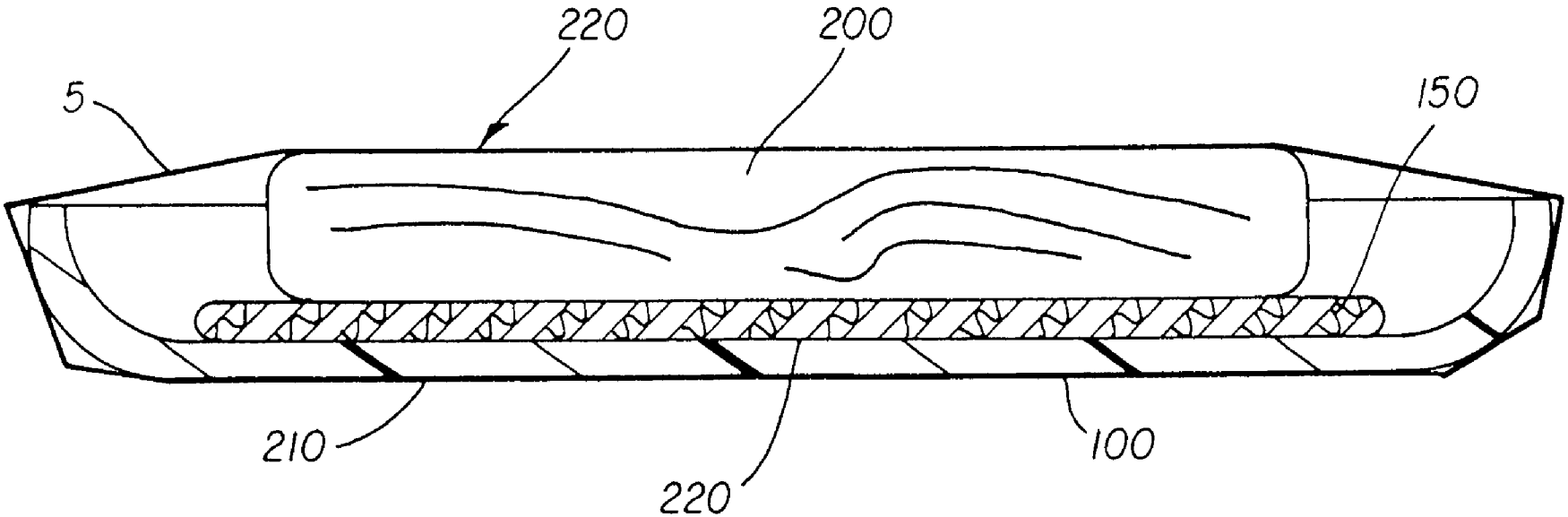
FIG. 8 is a perspective view of a food item, such as meat, fish or poultry, packaged in materials made in accordance with the present invention.

FIG. 8 shows a portion of meat, fish or poultry 200 in an assembled package 210 made in accordance with the present invention comprising the polystyrene tray 100 and absorbent pad 150 wrapped in the plastic wrap 10 as previously discussed. By using the tray 100, pad 150 and wrap 10 all of which incorporate the derivatized particles 15, the amount of "free" iron ions on the meat's surface 220 and in the fluids extrudated by the meat 200 and captured by the pad 150, are significantly reduced thus the growth of the micro-organisms on the meat's surface 220 is eliminated or significantly reduced.

Figure 9:
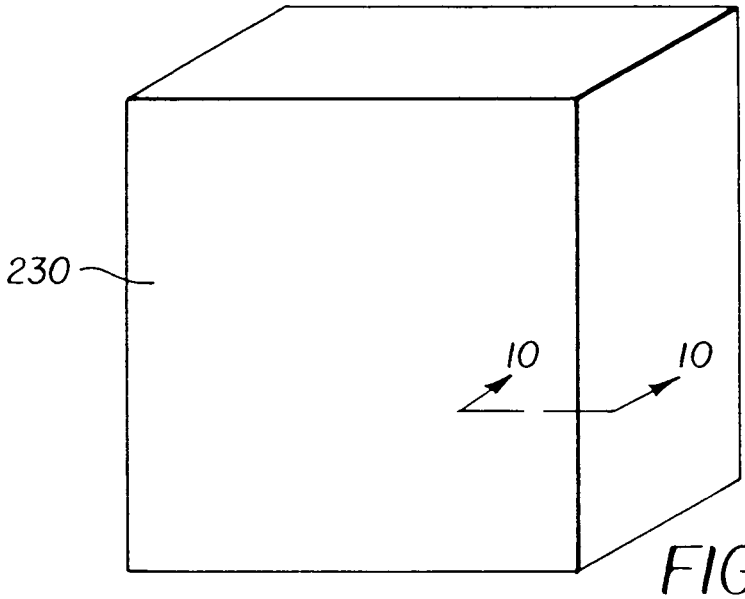
FIG. 9 is a schematic view of another rigid container made of a material made accordance with the present invention.
Figure 10:
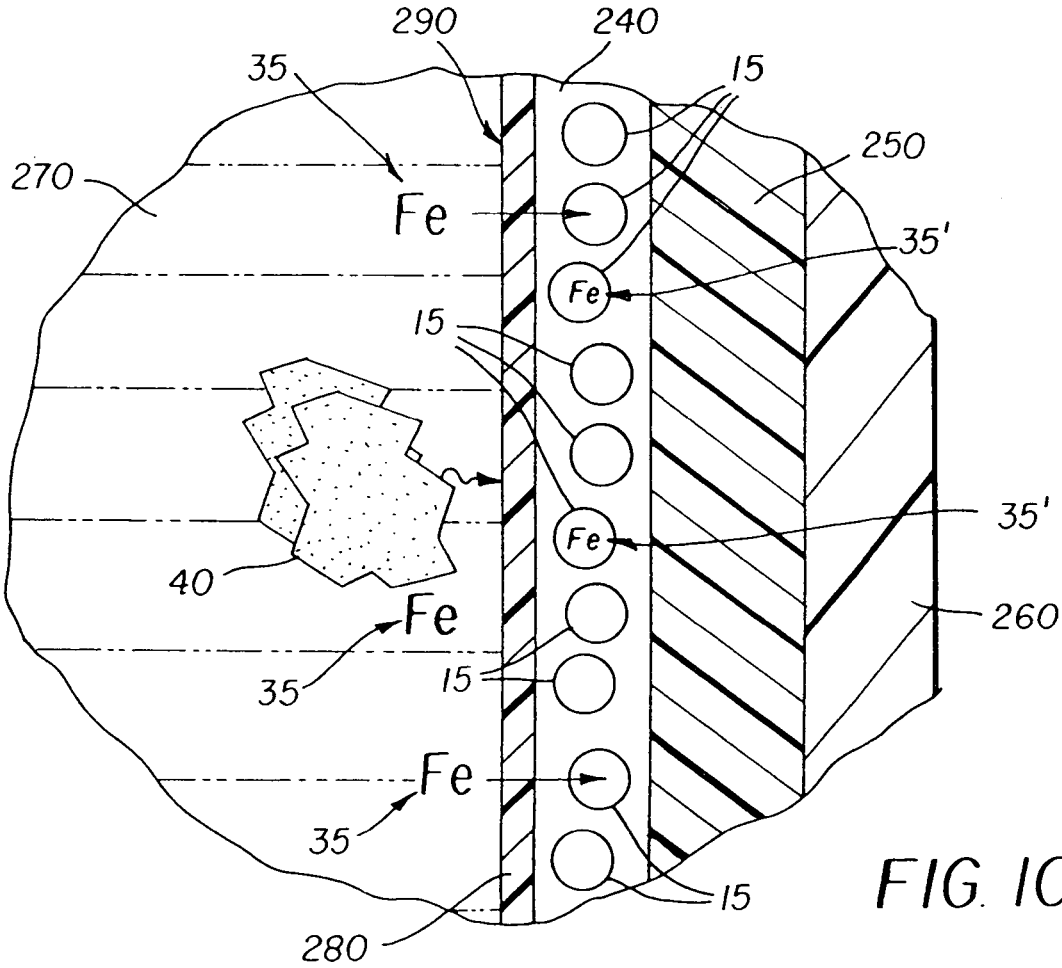
FIG. 10 is an enlarged partial cross sectional view of the of the material from which the container of FIG. 9 is made as taken along line 10-10.

Referring to FIGS. 9 and 10, there is illustrated yet another modified rigid packaging material in the form of a box 230 made in accordance with the present invention. In particular, the container comprises box 230. The box 230 is made of sheets of material layer together that comprises inner layer 240, a middle layer 250, and an outer layer 260. The inner layer 240 is in direct contact with the foodstuff contents 270 and is made of a hydrophilic polymer containing derivatized particles 15 the metal-ion sequestering agent as described above. The middle layer 250 and outer layer 260 may comprise a foil wrap or any other type of packaging material or combination thereof. There may be an additional barrier layer 280 also made of a water permeable polymer as previously described. Both the barrier layer 280 and inner layer 240 allow moisture and the "free" iron ion 35 to freely pass so the "free" iron ion 35 can reach and be captured by the metal-ion sequestering agent of the derivatized particle 15 as indicated by 35'. The micro-organism 40, however, is too large to pass through the barrier 280 or the inner layer 240 so it cannot reach the sequestered iron ion 35' now held by the derivatized particles 15. By using the derivatized particles 15 to significantly reduce the amount of "free" iron ions 35 on the inner surface 290 of the box 230, the growth of the micro-organism 40 is eliminated or significantly reduced.

The invention has been described in detail with particular reference to certain preferred embodiments thereof, but it will be understood that variations and modifications can be effected within the spirit and scope of the invention.

| PARTS LIST | |
|---|---|
| 10 | packaging material/plastic wrap |
| 12 | support layer |
| 15 | metal-ion sequestrant or derivatized particle |
| 18 | top surface |
| 20 | polymeric layer |
| 22 | liquid |
| 30 | barrier layer |
| 35 | "free" iron ion |
| 35' | sequestered iron ion |
| 40 | micro-organism |
| 100 | rigid packaging material/polystyrene tray |
| 110 | polystyrene material |
| 120 | core material |
| 130 | shell material |
| 137 | arrow |
| 140 | arrow |
| 150 | liquid absorbing pad |
| 155 | liquid extrudates |
| 160 | inner layer |
| 165 | arrow |
| 170 | outer layer |
| 180 | inner polymer |
| 185 | barrier layer |
| 200 | meat, fish, poultry |
| 210 | package |
| 220 | surface |
| 230 | box |
| 240 | inner layer |
| 250 | middle layer |
| 260 | contents |
| 270 | contents |
| 280 | barrier layer |
| 290 | inner surface |

The invention claimed is:

1. A packaging material used for wrapping foodstuffs and for inhibiting the growth of micro-organisms in foodstuffs, said packaging material having a metal-ion sequestering agent capable of removing designated metals ions from the surfaces of said foodstuffs and from liquid extrudates of foodstuffs, wherein said sequestering agent comprises derivatized nanoparticles comprising inorganic nanoparticles having an attached metal-ion sequestrant, wherein said inorganic nanoparticles have an average particle size of less than 200 nm and the derivatized nanoparticles have a stability constant greater than $10^{10}$ with iron (III), and wherein the metal-ion sequestrant is attached to the nanoparticle, by reacting the nanoparticle with a metal alkoxide intermediate of the sequestrant having the general formula:

$$M(OR)_{4-x}R'_x;$$

wherein M is silicon, titanium, aluminum, tin, or germanium;

x is an integer from 1 to 3;

R is an organic group; and

R' is an organic group containing an alpha amino carboxylate, a hydroxamate, or a catechol.

2. A packaging material according to claim 1 wherein said sequestering agent is immobilized on a support structure.

3. A packaging material according to claim 2 wherein said sequestering agent is immobilized on the support structure and has a high-affinity for biologically important metal-ions comprising Mn, Zn, Cu and Fe.

4. A packaging material according to claim 2 wherein said sequestering agent is immobilized on the support structure and has a high-selectivity for biologically important metal-ions comprising Mn, Zn, Cu and Fe.

5. A packaging material according to claim 4 wherein said sequestering agent is immobilized on the support structure and has a stability constant greater than $10^{20}$ with iron (III).

6. A packaging material according to claim 4 wherein said sequestering agent is immobilized on the support structure and has a stability constant greater than $10^{30}$ with iron (III).

7. A packaging material according to claim 2 wherein said support structure further comprises a polymeric layer containing said metal-ion sequestering agent.

8. A packaging material according to claim 7 wherein the polymeric layer is permeable to water.

9. A packaging material according to claim 7 wherein the polymeric layer has a water permeability of greater than 1000 $[(cm^3cm)/(cm^2sec/Pa)]\times10^{13}$.

10. A packaging material according to claim 7 wherein the polymeric layer has a water permeability of greater than 5000 $[(cm^3cm)/(cm^2sec/Pa)]\times10^{13}$.

11. A packaging material according to claim 7 wherein the polymeric layer comprises one or more of polyvinyl alcohol, cellophane, water-based polyurethanes, polyester, nylon, high nitrile resins, polyethylene-polyvinyl alcohol copolymer, polystyrene, ethyl cellulose, cellulose acetate, cellulose nitrate, aqueous latexes, polyacrylic acid, polystyrene sulfonate, polyamide, polymethacrylate, polyethylene terephthalate, polystyrene, polyethylene and polypropylene or polyacrylonitrile.

12. A packaging material according to claim 7 wherein the metal-ion sequestering agent comprises 0.1 to 50.0% by weight of a polymer in the polymeric layer.

13. A packaging material according to claim 7 further comprising a barrier layer wherein the polymeric layer is between the surface of the packaging material and the barrier layer and wherein the barrier layer does not contain the derivatized nanoparticles.

14. A packaging material according to claim 13 wherein the barrier layer is permeable to water.

15. A packaging material according to claim 13 wherein the barrier layer has a water permeability of greater than 1000 $[(cm^3cm)/(cm^2sec/Pa)]\times10^{13}$.

16. A packaging material according to claim 13 wherein the barrier layer has a thickness in the range of 0.1 microns to 10.0 microns.

17. A packaging material according to claim 13 wherein the barrier layer comprises one or more of polyvinyl alcohol, cellophane, water-based polyurethanes, polyester, nylon, high nitrile resins, polyethylene-polyvinyl alcohol copolymer, polystyrene, ethyl cellulose, cellulose acetate, cellulose nitrate, aqueous latexes, polyacrylic acid, polystyrene sulfonate, polyamide, polymethacrylate, polyethylene terephthalate, polystyrene, polyethylene and polypropylene or polyacrylonitrile.

18. A packaging material according to claim 13 wherein microbes cannot pass or diffuse though the barrier layer.

19. A packaging material according to claim 1 wherein said packaging material is made of glass, metal, plastic or paper.

20. A packaging material according to claim 1 wherein said packaging material comprises a plurality of layers having an outer layer having sequestering agent.

21. A packaging material according to claim 1 wherein said packaging material comprises a plurality of layers comprising an outer barrier layer for contact with said foodstuff and an inner layer having said sequestering agent, said inner layer having a first side adjacent said barrier layer, said barrier layer allowing liquid to pass through to said inner layer.

22. A packaging material according to claim 21 wherein a second outer layer is provided on a second side of said inner layer.

23. A packaging material according to claim 22 wherein said second outer layer is a second barrier layer that also allows liquid to pass through to said inner layer.

24. A packaging material according to claim 1 wherein said inorganic nanoparticles have an average particle size of less than 100 nm.

25. A packaging material according to claim 1 wherein said inorganic nanoparticles have an average particle size of less than 50 nm.

26. A packaging material according to claim 1 wherein said inorganic nanoparticles comprise silica oxides, alumina oxides, boehmites, titanium oxides, zinc oxides, tin oxides, zirconium oxides, yttrium oxides, hafnium oxides, clays, or alumina silicates.

27. A packaging material according to claim 1 wherein said inorganic nanoparticles have a specific surface area of greater than 100 $m^2/g$.

28. A packaging material according to claim 1 wherein said sequestering agent is integrally formed as a part of said material.

29. A packaging material according to claim 28 wherein said packaging material is formed as rigid or semi-rigid structure for holding of said foodstuff.

30. A packaging material according to claim 29 wherein said rigid or semi-rigid structure is substantially in the shape of tray having a substantially continuous outer raised periphery.

31. A packaging material according to claim 1 wherein said packaging material is in the form of a flexible sheet that can be wrapped about said foodstuff.

32. A packaging material used for wrapping foodstuffs and for inhibiting the growth of micro-organisms in foodstuffs, said packaging material having a metal-ion sequestering agent capable of removing designated metals ions from the surfaces of said foodstuffs and from liquid extrudates of foodstuffs, wherein said sequestering agent comprises derivatized nanoparticles comprising inorganic nanoparticles having an attached metal-ion sequestrant, wherein said inorganic nanoparticles have an average particle size of less than 200 nm and the derivatized nanoparticles have a stability constant greater than $10^{10}$ with iron (III), and wherein said metal-ion sequestrant is attached to the nanoparticle by reacting the nanoparticle with a silicon alkoxide intermediate of the sequestrant having the general formula:

$$Si(OR)_{4-x}R'_x;$$

wherein x is an integer from 1 to 3;

R is an alkyl group; and

R' is an organic group containing an alpha amino carboxylate, a hydroxamate, or a catechol.

33. A packaging material according to claim 32 wherein said sequestering agent is immobilized on a support structure.

34. A packaging material according to claim 33 wherein said sequestering agent is immobilized on the support structure and has a high affinity for biologically important metal-ions Mn, Zn, Cu and Fe.

35. A packaging material according to claim 33 wherein said sequestering agent is immobilized on the support structure and has a high selectivity for biologically important metal-ions Mn, Zn, Cu and Fe.

36. A packaging material according to claim 35 wherein said sequestering agent is immobilized on the support structure and has a stability constant greater than $10^{20}$ with iron (III).

37. A packaging material according to claim 35 wherein said sequestering agent is immobilized on the support structure and has a stability constant greater than $10^{30}$ with iron (III).

38. A packaging material according to claim 32 wherein said packaging material is made of glass, metal, plastic or paper.

39. A packaging material according to claim 32 wherein said packaging material comprises a plurality of layers having an outer layer having sequestering agent.

40. A packaging material according to claim 32 wherein said packaging material comprises a plurality of layers comprising an outer barrier layer for contact with said foodstuff and an inner layer having said sequestering agent, said inner layer having a first side adjacent said barrier layer, said barrier layer allowing liquid to pass through to said inner layer.

41. A packaging material according to claim 40 wherein a second outer layer is provided on a second side of said inner layer.

42. A packaging material according to claim 41 wherein said second outer layer is a second barrier layer that also allows liquid to pass through to said inner layer.

43. A packaging material according to claim 32 further comprising a support comprising a polymeric layer containing said metal-ion sequestering agent.

44. A packaging material according to claim 43 wherein the polymeric layer is permeable to water.

45. A packaging material according to claim 43 wherein the polymeric layer has a water permeability of greater than 1000 $[(cm^3cm)/(cm^2sec/Pa)]\times10^{13}$.

46. A packaging material according to claim 43 wherein the polymeric layer has a water permeability of greater than 5000 $[(cm^3cm)/(cm^2sec/Pa)]\times10^{13}$.

* * * * *